United States Patent [19]

Moede

[11] 4,027,413

[45] June 7, 1977

[54] CLIP FOR RETAINING A CANVAS STRETCHER FRAME IN A DECORATIVE PICTURE FRAME

[75] Inventor: Earl J. Moede, San Jose, Calif.

[73] Assignee: McNeill Favia Co., Mountan View, Calif.

[22] Filed: June 18, 1976

[21] Appl. No.: 697,313

[52] U.S. Cl. ..... 40/156

[51] Int. Cl.[2] ..... G09F 1/12

[58] Field of Search ..... 40/156, 152

[56] References Cited

UNITED STATES PATENTS

| | | | |
|---|---|---|---|
| 481,117 | 8/1892 | Naegele | 40/156 |
| 951,921 | 3/1910 | Spencer | 40/156 |
| 2,698,470 | 1/1955 | Buedingen | 40/156 X |
| 2,807,110 | 9/1957 | Buedingen | 40/156 |
| 2,820,311 | 1/1958 | Hamlin | 40/156 |

*Primary Examiner*—Louis G. Mancene

*Assistant Examiner*—Wenceslao J. Contreras

*Attorney, Agent, or Firm*—Thomas H. Olson

[57] ABSTRACT

A clip, two or more of which can be employed to retain a canvas stretcher frame within a decorative picture frame. Canvases are typically fixed to a frame formed of a plurality of stretcher bars having rectangular cross-sectional shapes, such frame being adapted for placement into a rabbet groove at the rear of the decorative frame. The disclosed clip has a main body of a length somewhat greater than the width of the stretcher bars. Extending from one end of the main body and integral therewith is a leg having at least one outward projecting point which is adapted to pierce the surface of the decorative frame that defines the rabbet groove. The main body extends across the rear surface of the stretcher bar and has a second leg which resiliently engages the inner edge of the stretcher bar as to retain the clip in place, which in turn retains the stretcher frame within the decorative frame.

9 Claims, 4 Drawing Figures

Fig-1
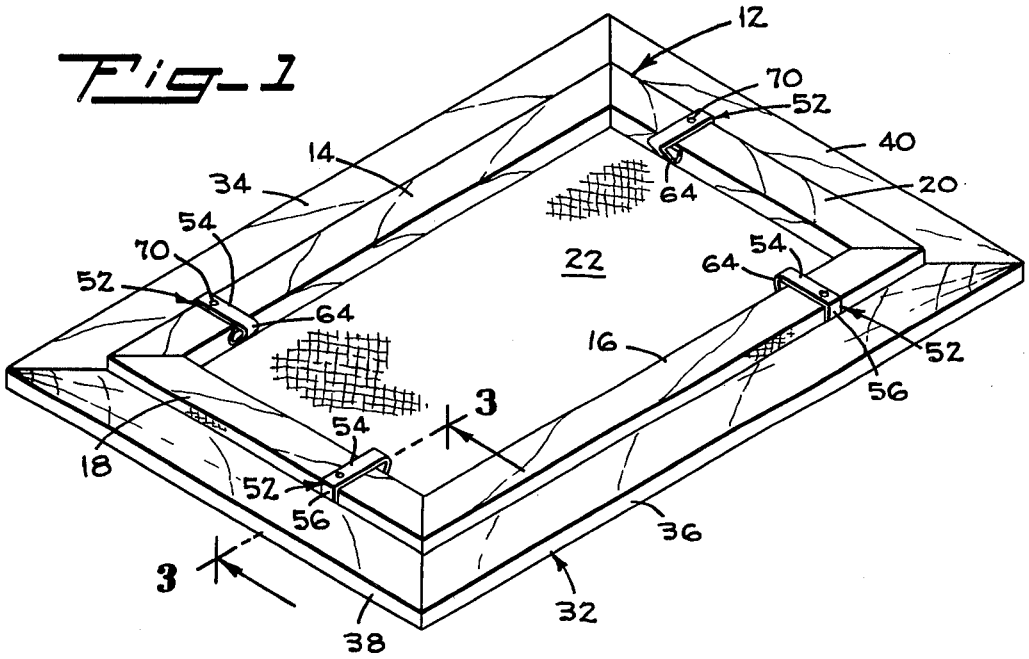
Fig-2
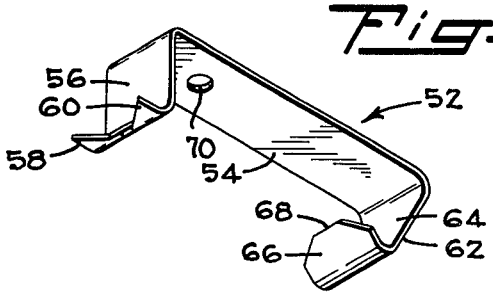
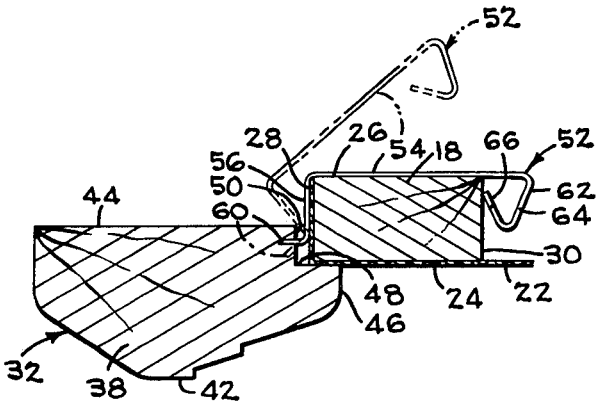
Fig-3
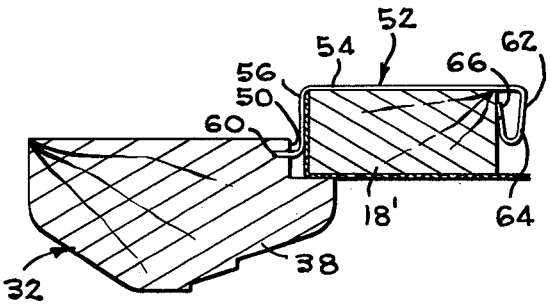
Fig-4

CLIP FOR RETAINING A CANVAS STRETCHER FRAME IN A DECORATIVE PICTURE FRAME

BACKGROUND OF THE INVENTION

1. Field of the Invention:

This invention relates to a clip for retaining a canvas stretcher frame within a decorative picture frame.

2. Description of the Prior Art:

As far as is known prior art techniques for securing canvas stretcher frames within picture frames take either the form of a plurality of small nails driven into the frame members at an angle or a turn button fixed to the decorative frame and rotatable to a position at which the canvas stretcher frame is engaged and retained in the decorative frame. The former technique is disadvantageous in that it is insecure and it frequently results in splitting or otherwise damaging the frame members. The latter prior art technique is not satisfactory in that it imposes extraordinary dimensional tolerances on the parts to effect secure retention of the canvas stretcher frame within the decorative frame.

SUMMARY OF THE INVENTION

The embodiment of the invention that is described in more detail hereinafter includes a one piece clip formed of resilient spring steel. The clip has a main body having a length exceeding the width of the stretcher bars that form the canvas frame. Extending from one end of the clip is a leg from the distal end of which extends one or more points adapted to pierce the surface of the rabbet groove formed in the decorative frame. The length of such leg is less than the thickness of the stretcher bar. On the opposite end of the main body of the clip and integral therewith is an inward extending V-shaped leg which has sufficient resilience to accommodate the clip to stretcher bars of different widths and has a free end which frictionally engages the inner edge of the stretcher bar to retain the clip in place.

An object of the invention is to provide a frame clip that can be quickly installed without employment of any tools. Contributing to the achievement of this object is the orientation of the outward extending points at the distal end of the first leg such that the points can be introduced into the slot between the canvas stretcher frame and the rabbet groove and can form a fulcrum about which the entire clip is rotated during installation. Also contributing to achievement of this object is the inward extending V-shaped leg at the opposite end which retains the main body of the clip flat against the rear surface of the stretcher bar.

Another object of the invention is to provide a clip which is arranged to accommodate stretcher bars of different dimensions. Because the first leg has a length somewhat less than the thickness of the stretcher bar, the previously mentioned points can pierce the rabbet groove at any suitable location. The above mentioned V-shaped leg has a sufficient degree of resilience that it engages stretcher bars of different widths.

A further object is to provide a frame clip of the type referred to above that is readily removeable should it be desired to remove the canvas stretcher frame from the decorative frame. Achievement of this object is possible because the free end of the above mentioned V-shaped leg frictionally engages the edge surface of the stretcher bar and can be removed therefrom merely by rotating the clip about a fulcrum formed by the points on the opposite ends of the clip that engage the rabbet groove.

The foregoing, together with other objects, features and advantages will be more apparent after referring to the following specification and the accompanying drawing.

BRIEF DESCRIPTION OF THE DRAWING

FIG. 1 is a perspective view of the rear of a canvas stretcher frame showing it installed into a decorative frame by clips formed according to the invention.

FIG. 2 is a perspective view of a preferred form of clip according to the present invention.

FIG. 3 is a view taken along line 3—3 of FIG. 1, the clip in its start position being shown in broken lines.

FIG. 4 is a view similar to FIG. 3 showing the clip installed to retain a stretcher bar having a width greater than that shown in FIG. 3.

DESCRIPTION OF THE PREFERRED EMBODIMENT

Referring more particularly to the drawing reference numeral 12 indicates a canvas stretcher frame of conventional form. Frame 12 includes side stretcher bars 14 and 16 and end stretcher bars 18 and 20 which are assembled in a rectangular configuration to form a rectangular frame on which a canvas 22 is tautly secured, the canvas typically bearing a work of art. Stretcher bars 14–20 of frame 12 have rectangular cross sections as exemplified by stretcher bar 18 shown in FIG. 3. Stretcher bar 18 has a front face 24 over which canvas 22 is stretched, a rear face 26, an outer edge surface 28, and an inner edge surface 30. One frequently employed size for the stretcher bars is about 1⅝ inches wide and about ¾ inch thick. The above recited dimensions are not critical, however, insofar as the present invention is concerned.

Reference numeral 32 indicates generally a decorative frame of conventional form. The decorative frame is composed of side members 34 and 36 and end members 38 and 40 assembled in a rectangular shape. As seen in FIG. 3 frame member 38, which exemplifies the other frame members forming frame 32, includes a front decorative face 42 and a rear face 44. The frame member includes an inner edge 46 in which is formed a rabbet groove having a rearward facing surface 48 and an inward facing surface 50 which is substantially perpendicular to the face 48. As shown in FIGS. 3 and 4 decorative frame 32 is dimensioned so that there is a small clearance space between the outer periphery of canvas stretcher frame 12 and the inner periphery of surface 50 of the rabbet groove. The members constituting frames 12 and 32 are typically formed of relatively soft wood, and although the clip of the invention is adapted to accommodate frames of such material, it can be employed to advantage with virtually any pierceable material as will appear subsequently.

The clip of the invention is identified generally at 52. One specific clip designed according to the present invention is formed of steel strapping having a width of about ½ inch and a thickness of about 0.023 inches. Such material has a heat treat range of approximately 113,000 – 140,000 psi and is commercially available in roll form for use in strapping packages for shipment. The above mentioned heat treating range is such that the material is formable into the required shape but still possesses a sufficient degree of resilience to achieve the objects of the invention.

Clip 52 includes a main body 54 that, as seen in FIGS. 3 and 4, has a length exceeding the width of stretcher bar 18. Extending from one end of main body 54 is a first leg 56 that has a length less than the thickness of stretcher bar 18. At the distal end of first leg 56, i.e. the end remote from main body 54, are two sharpened tooth-like members 58 and 60. The members extend from the plane of first leg 56 by a distance greater than the clearance space between the outer periphery of canvas stretcher frame 12 and the rabbet groove in decorative frame 32. In one clip designed according to the present invention, tooth-like members 58 and 60 extend outward of leg 56 by approximately ¼ inch.

Clip 52 has at the end of body 54 opposite from first leg 56 a second leg 62. Leg 62 includes a proximal portion 64 that defines an acute angle with respect to main body 54, and a distal portion 66 which, as seen in FIG. 3, cooperates with proximal portion 64 to define a retainer of generally V-shaped configuration. Proximal portion 64 and distal portion 66 are so proportioned that the apex of the V-shaped configuration is spaced from main body 54 by a distance no greater than the thickness of stretcher bar 18 so as not to deform canvas 22. Distal portion 66 has a free end 68 which is spaced from first leg 56 by an amount less than the width of stretcher bar 18 so as frictionally to engage inner surface 30 of the stretcher bar (see FIG. 3).

Operation of the clip of the invention can be appreciated by assuming that decorative frame 32 has been constructed of such size as to form a peripheral clearance space between the outer extremity of canvas stretcher frame 12 and surface 50 of the rabbet groove in the decorative frame. The stretcher frame is placed within the rabbet groove with the front surface of canvas 22 bearing against rabbet groove surface 48. First leg 56 of clip 52 is introduced into the clearance space, the main body 54 being tilted upward as shown in broken lines in FIG. 3 to permit entry of tooth-shaped portions 58 and 60 into the clearance space. Thereupon force is applied to clip 52 at a point remote from the first leg 56 in a downward direction (as viewed in FIG. 3) so that main body 54 moves into a position lying along rear face 26 of stretcher bar 18. Because of the dimensional relationship of the elements of clip 52 with respect to the width of stretcher bar 18, free end 68 of distal portion 66 frictionally engages edge surface 30 of the stretcher bar and retains the clip in place, which in turn retains tooth-shaped members 58 and 60 into engagement with the portion of decorative frame member 38 adjacent rabbet surface 50. It will be noted in FIG. 1 that two or more clips 52 are employed, and it is also possible in installing large pictures to employ two clips along each bar of the frame.

FIG. 4 illustrates that clip 52 can be employed to retain a stretcher bar 18′ of greater width within the decorative frame. In FIG. 4 it can be seen that members 64 and 66 of leg 62 are deformed so as to accommodate the relatively wider stretcher bar 18′ while still performing the function of retaining the clip in place, thereby retaining the canvas stretcher frame within the decorative frame.

An important characteristic of the clip of the invention can be perceived from FIG. 2. In FIG. 2 it will be noticed that the shape of free end 68 is complementary to the shape of the extremity of first leg 56 at which tooth-shaped members 58 and 60 are formed. The consequence of this characteristic is that in producing the clips of the invention a single cutting die suffices to sever the blank for clip 52 (before bending) from a long length of strip material. Consequently wastage of both production time and material is eliminated by the above mentioned complementary relationship.

Clip 52 can be optionally provided with a small hole 70. Hole 70 is formed in main body 54 and is disposed relatively close to first leg 56. Hole 70 affords one of two functions; it accommodates a small nail or brad for fixing the clip to stretcher bars that are narrower than the distance between first leg 56 and the free end 68 of second leg 62, or it affords attachment of a picture wire to the rear of the assembled frame to facilitate hanging the frame structure when assembled. In order to afford achievement of one or the other of these functions hole 70 must be spaced sufficiently far from leg 56 so that upon installation of a small nail or brad, the stretcher bars will not be split, and the hole has to be sufficiently close to first leg 56 that when the hole is used to attach a picture wire there will be applied to second leg 62 insufficient force to cause it to disengage from inner edge surface 30 of the stretcher bar.

A clip designed according to the invention which is satisfactory for most present day canvas stretcher frames has a main body with a width of ½ inch and an overall length of about 1 15/16ths inches. First leg 56 has a length such that tooth-shaped portions 58 and 60 are spaced from the main body by approximately 11/16ths of an inch. The second leg 62 is so proportioned that the apex of the V-shaped configuration is spaced approximately ½ inch from the main body and free end 68 is spaced from the main body by about 5/16ths of an inch. The space between first leg 56 and free end 68 is about 1.45 inches, such clip, because of the deformability of the V-shaped leg 62, accommodates stretcher bars having widths in the range of about 1.5 to 1.7 inches. In such exemplary clip, hole 70 is spaced from first leg 56 by about ⅛– 3/16 inch. Such clip accommodates the majority of present day canvas stretcher frames.

Thus it will be seen that the present invention provides a clip which is inexpensive and relatively easy to fabricate. More importantly, employment of two or more of the clips materially simplifies the installation and removal of canvas stretcher frames into decorative frames. Not only can the installation be achieved without employment of any tools but it avoids any damage either to the canvas frame stretcher bars or to the decorative frame. Moreover, the clip can be simply removed should it be desired to remove the canvas stretcher frame from the decorative frame by merely reversing the steps described above in connection with installation of the clip.

Although one embodiment has been shown and described, it will be obvious that other adaptations and modifications can be made without departing from the true spirit and scope of the invention.

What is claimed is:

1. An article of manufacture comprising a strip of resilient material having an elongate main body, a first leg extending from one end of the body and a second leg extending from the opposite end of the body, said first leg being generally normal to said main body and having at the distal end thereof at least one point extending outward therefrom in general parallelism with said main body, the material having sufficient strength that the point is substantially immovable relative to said first leg, said second leg having a resiliently deformable portion for effecting frictional engagement with a surface of a rigid bar disposed intermediate said first and second legs, said article of manufacture affording installation of a first polygonal canvas stretcher frame into a second decorative frame which has a rabbet groove for receiving said first frame thereinto, said second frame being proportioned so that a clearance space is defined between the outer edge of said first frame and a surface of said rabbet groove which clearance space is less than the extent of said point, said first frame being formed of stretcher bars having a width greater than the distance between said first leg and said resiliently deformable portion and a thickness greater than the length of said first and second legs so that said point can be introduced into said clearance space and the article can be rotated to cause said point to be pierced into a portion of said second frame defining said rabbet groove and to bring said main body against the rear surface of said stretcher bar there to be retained by frictional engagement between said resiliently deformable portion on said second leg and an edge surface of said stretcher bar remote from said rabbet groove.

2. An article of manufacture according to claim 1 wherein said second leg includes a proximal portion extending from said main body and a distal portion integral with said proximal portion, said distal portion being disposed in the space intermediate said first and second legs and constituting said resilient means.

3. An article of manufacture according to claim 2 wherein said proximal portion and said distal portion of said second leg form a generally V-shaped configuration, said distal portion having a free end constituting said friction surface.

4. An article of manufacture according to claim 3 wherein said free end and said point on said first leg are complementally shaped so that both can be formed by one machine operation.

5. An article of manufacture according to claim 1 including a second point spaced laterally from first said point, said points extending from opposite edges of said strip to pierce said rabbet groove at spaced apart points.

6. An article of manufacture according to claim 1, wherein a portion of said main body adjacent said first leg defines a hole, said hole being sized to receive a small nail or a picture wire therethrough.

7. An article of manufacture according to claim 1 wherein said strip has a width of approximately ½ inch and a heat treat range of approximately 113,000 – 140,000 psi.

8. A clip for securing a rigid bar having a generally rectangular cross sectional shape to a member having a rabbet groove therein, the rabbet groove having a rearward facing surface and an inward facing surface perpendicular to the rearward facing surface and the clip acting to retain the bar in contact with the rearward facing surface, said clip comprising a strip of resilient material having an elongate main body, a first leg extending generally perpendicularly from one end of the body and a second leg extending generally perpendicularly from the opposite end of the body so as to receive said bar therebetween, said first leg being generally normal to said main body and having at the distal end thereof at least one point extending outward therefrom in general parallelism with said main body and substantially immovable relative thereto for piercing entry into said inward facing surface, said second leg having a resilient portion for effecting frictional engagement with said bar when said bar is received between said legs so as to retain said point in piercing relation to said inward facing surface.

9. A method for retaining a canvas stretcher frame into a rabbet groove in the rear of a decorative frame, which rabbet groove has a rearward facing surface and an inward facing surface perpendicular to the rearward facing surface, the method comprising the steps of: providing a clip having an elongate main body, a first leg extending generally perpendicularly from one end of the body, at least one point extending outward from the distal extremity of the first leg and a second leg extending generally perpendicularly from the other end of the body and having a resilient portion for effecting frictional engagement of a stretcher bar between the first and second legs; installing the stretcher frame in the rabbet groove with the surface of the canvas on the frame contacting the rearward facing surface of the rabbet groove; then placing the point and the first leg of the clip into the clearance space between the stretcher frame and the inward facing surface of the rabbet groove with the body of the clip extending obliquely outward from the rear of the stretcher frame; and finally rotating the clip about a fulcrum formed by the site of engagement between the point and the inward facing surface of the rabbet groove to move the second leg of the clip into frictional engagement with the stretcher frame.

* * * * *